United States Patent [19]

Ivan

[11] Patent Number: 4,870,871

[45] Date of Patent: Oct. 3, 1989

[54] ADJUSTABLE ACCELERATOR AND BRAKE PEDAL MECHANISM

[75] Inventor: Steve D. Ivan, St. Clair Shores, Mich.

[73] Assignee: Wickes Manufacturing Company, Southfield, Mich.

[21] Appl. No.: 277,426

[22] Filed: Nov. 25, 1988

Related U.S. Application Data

[63] Continuation of Ser. No. 53,886, May 22, 1987, abandoned.

[51] Int. Cl.[4] ..... G05G 1/14

[52] U.S. Cl. ..... 74/513; 74/512; 74/560

[58] Field of Search ..... 74/512, 513, 514, 515 R, 74/560, 561, 117, 103, 522, 500.5, 501.6, 504, 505, 506; 280/261; 192/3 R

[56] References Cited

U.S. PATENT DOCUMENTS

| | | | |
|---|---|---|---|
| 322,422 | 7/1885 | Collyer | 74/512 |
| 2,927,667 | 3/1960 | Herrmann | 74/513 |
| 3,282,125 | 11/1966 | Dully | 74/560 |
| 3,511,109 | 5/1970 | Tanaka | 74/560 |
| 3,585,949 | 6/1971 | Chudner | 74/512 |
| 3,643,524 | 2/1972 | Herring | 74/512 |
| 3,643,525 | 2/1972 | Gibas | 74/512 |
| 3,691,868 | 9/1972 | Smith | 74/512 |
| 3,722,491 | 3/1973 | Maeda | 192/3 R |
| 3,754,480 | 8/1973 | Bodnar | 74/512 |
| 3,788,415 | 1/1974 | Tilley | 74/512 |
| 3,797,356 | 3/1974 | Duffy et al. | 74/512 |
| 3,828,625 | 8/1974 | Bruhn | 74/560 X |
| 4,133,550 | 1/1979 | Brown | 280/261 |
| 4,221,136 | 9/1980 | Visconti | 74/117 |
| 4,255,984 | 3/1981 | Abels et al. | 74/512 |

FOREIGN PATENT DOCUMENTS

| | | | |
|---|---|---|---|
| 2640769 | 3/1978 | Fed. Rep. of Germany | 74/512 |
| 952831 | 3/1964 | United Kingdom | 74/560 |

*Primary Examiner*—Vinh T. Luong
*Attorney, Agent, or Firm*—David A. Greenlee

[57] ABSTRACT

A mechanism for adjusting the fore and aft positions of motor vehicle pedal assemblies is provided. The assembly includes a pair of parallel, threaded shafts, each of which is connected to a gear assembly for simultaneous rotation. A cross rod is threadably mounted to each shaft and one or more pedal assemblies are pivotably mounted to the cross rod. The pedal assemblies and cross rod move in a direction which is parallel to the threaded shafts upon rotation of these shafts. A pulley assembly is also threadably mounted to one of the shafts and moves in the same directions as the cross rods during shaft rotation. The pulley cable is connected at one end to an accelerator pedal assembly and at the opposite end to the vehicle throttle. An elongate housing is connected to the booster input for the vehicle braking system while a threaded rod extending therefrom is connected to a brake pedal assembly. The housing is rotated in unison with the threaded shafts, thereby causing the threaded rod to move in the same direction as the brake pedal assembly.

4 Claims, 4 Drawing Sheets

ADJUSTABLE ACCELERATOR AND BRAKE PEDAL MECHANISM

This application is a continuation of application Ser. No. 053,886, filed May 22, 1987, now abandoned.

BACKGROUND OF THE INVENTION

1. Field of the Invention.

The field of the invention relates to a mechanism for adjusting the fore and aft positions of the pedals of an automobile.

2. Brief Description of the Prior Art.

The advantages of adjustable brake and accelerator pedals for automobiles has been recognized for a number of years by manufacturers and operators of motor vehicles. Such pedals may be adjusted as a unit or individually. U.S. Pat. Nos. 3,282,125, 3,511,109 and 3,754,480 disclose examples of the first-described type of adjustment mechanism. U.S. Pat. No. 3,691,868 concerns a pedal adjustment mechanism including an electric motor. The pedal levers are not displaced with respect to their carrier link, and the outputs of the pedals accordingly are not affected by adjustments in either direction.

Other patents concerning pedal adjustment means include U.S. Pat. Nos. 3,151,499, 3,178,962, 3,224,293, 3,242,763, 3,301,088, 3,319,487, 3,643,525, 3,828,625 and 3,869,279. 3,643,525 discloses a mechanism for adjusting the positions of brake and accelerator pedals in unison through the use of simultaneously rotating Acme screws.

SUMMARY OF THE INVENTION

A mechanism for moving the pedals of a motor vehicle in fore and aft directions is provided. Means are provided for moving the pedals in unison while insuring that their operating characteristics remain the same regardless of position with respect to the fire wall.

In a preferred embodiment of the invention, brake and accelerator pedal assemblies are pivotably mounted, respectively, to a cross rod which is threadably secured to a pair of threaded shafts. Each of the shafts is rotatable about its longitudinal axis. Internally threaded pivot bushings are mounted to each shaft for urging the cross rod and respective pedal assemblies in each direction.

A push rod assembly is pivotably mounted to the lever connecting the brak pedal to the cross rod. It includes an externally threaded rod positioned within the threaded bore of an elongate housing. The housing is rotatable in unison with the associated threaded shaft which allows the threaded rod to move in fore and aft directions. This maintains the brake pedal at a constant angular orientation regardless of the position of the cross rod.

The accelerator pedal assembly includes a cable secured to the lever connecting the accelerator pedal to the cross rod. The cable extends about a pulley which is mounted to the threaded shaft by means of an internally threaded bushing. Rotation of the threaded shaft accordingly causes both the accelerator pedal assembly and the pulley to move in the same direction, thereby maintaining the cable at constant length and tension.

DETAILED DESCRIPTION OF THE INVENTION

Figure 1:
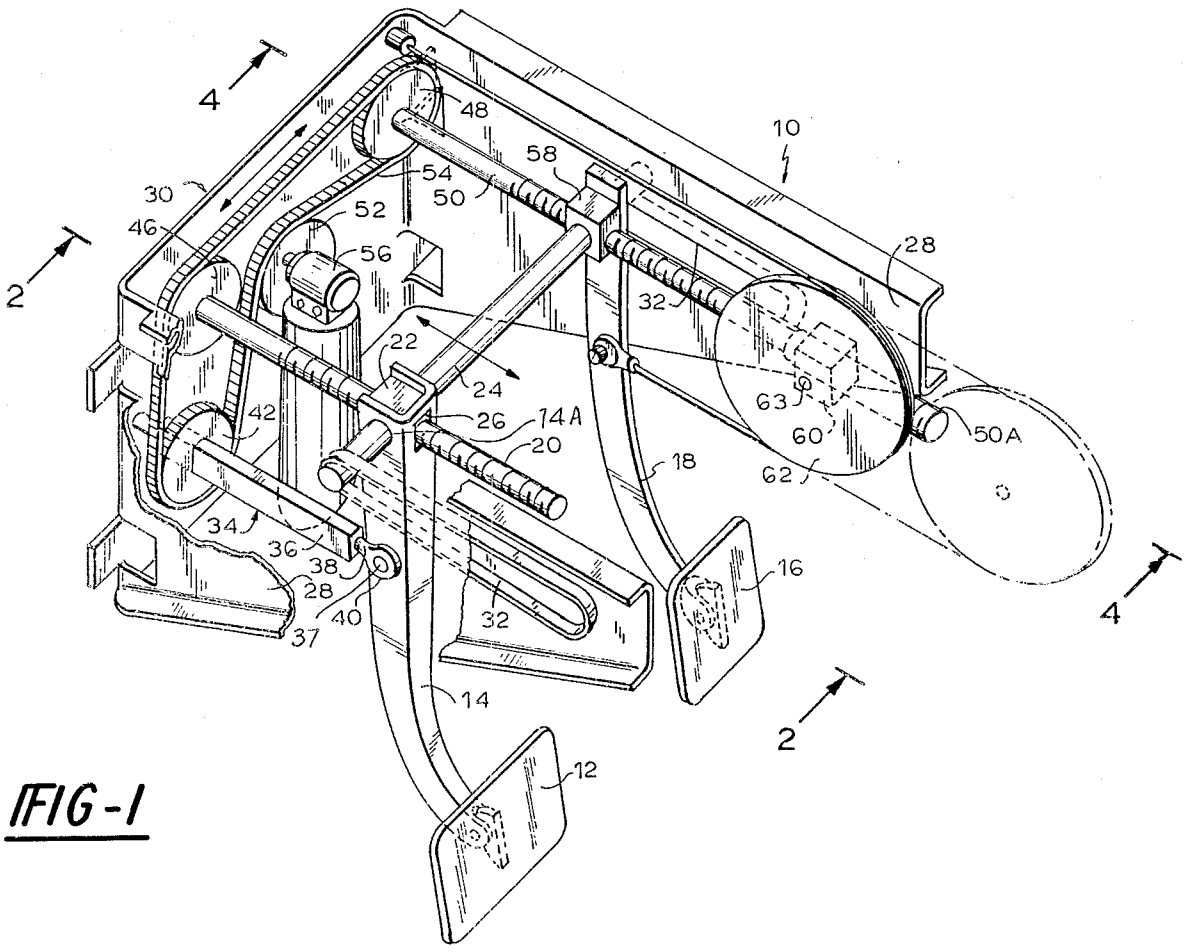
FIG. 1 is a partially cutaway perspective view of a brake and accelerator pedal assembly in accordance with the invention.

A pedal assembly 10 for a motor vehicle is shown in FIG. 1. The assembly includes a brake pedal assembly comprising a foot pad 12 and lever 14, an accelerator pedal assembly comprising a foot pad 16 and lever 18, and mechanism for adjusting the fore and aft positions of the two pedal assemblies.

Figure 2:
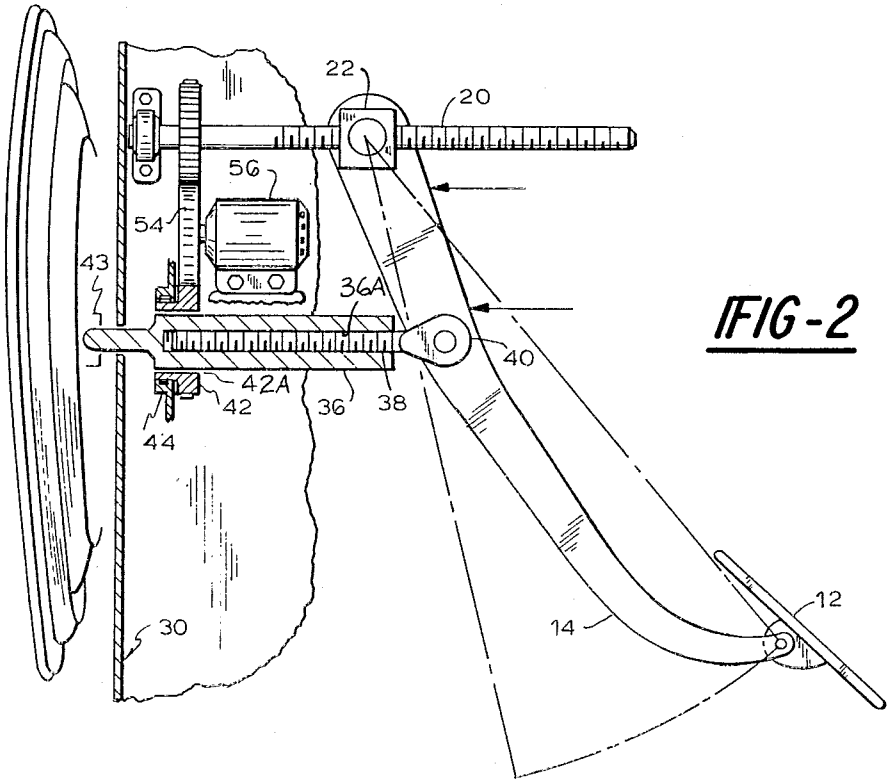
FIG. 2 is a side elevation view of a brake pedal assembly in accordance with the invention.
Figure 3:
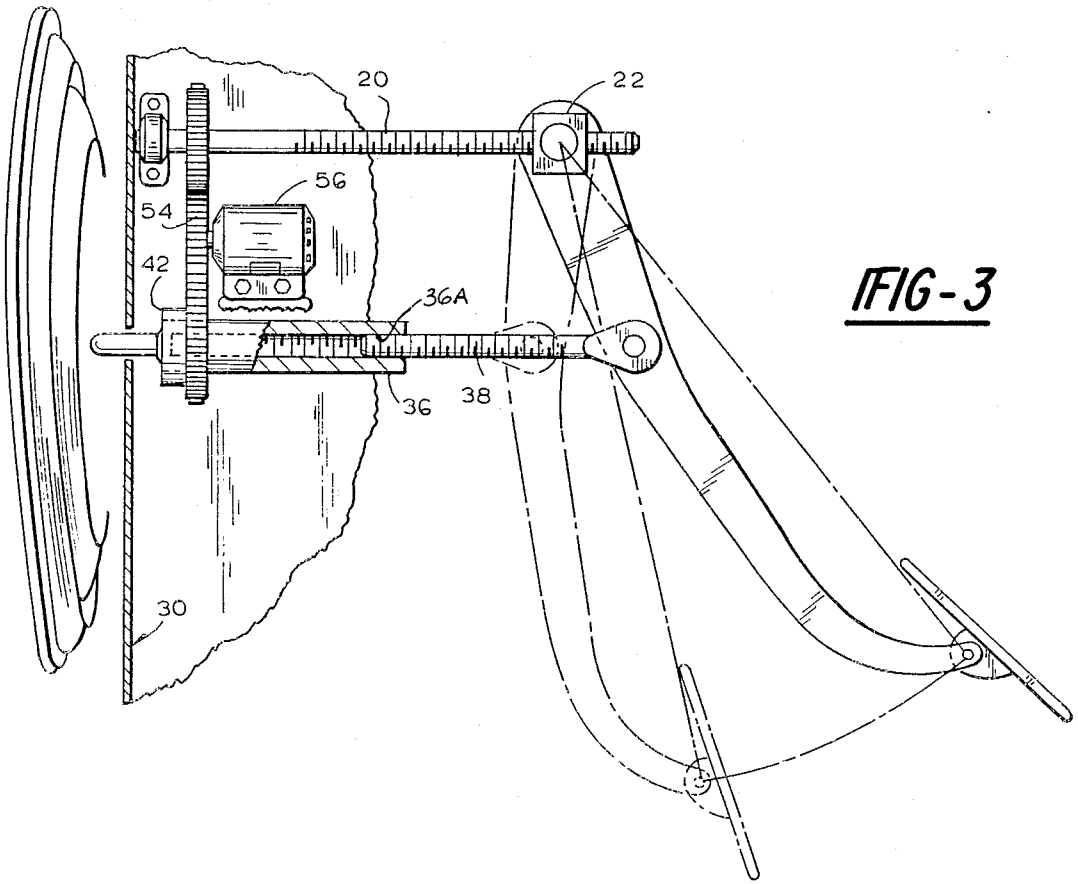
FIG. 3 is the same view as FIG. 2 showing the brake pedal in a different position.

Referring to FIGS. 1–3, the brake lever is secured to a first threaded shaft 20 by means of an internally threaded pivot bushing 22 and a cross rod 24 which extends within an opening 14A within the lever. The lever 14 associated with the brake pedal assembly has a generally U-shaped cross section and is pivotable about the cross rod 24. The cross rod extends through the pivot bushing while the threaded shaft 20 extends through the cross rod. The opening 26 in the lever 14 through which the threaded shaft extends is elongated to allow the lever to pivot about the cross rod. The side walls 28 of the assembly housing or support 30 each include a slot 32 which receives an end of the cross rod. This arrangement limits the horizontal distance the pedal assemblies may travel.

A push rod assembly 34 is secured to the brake lever 14 by means of a pivot pin 37 extending laterally from the lever between the foot pad 12 and pivot bushing 22. This assembly includes a substantially rectangular, elongate actuator housing 36 having a threaded internal bore 36A. A threaded rod 38 is positioned within the bore and includes an eyelet 40 at one end thereof. The pivot pin 36 extends through the eyelet.

The push rod housing 36 extends through a rectangular opening 42A in a first gear 42 and is connected to the booster input 43. Sufficient clearance is provided between the gear opening and the housing to allow for limited vertical movement as the brake pedal assembly swings through the arc indicated in broken lines in FIGS. 2 and 3 to control braking. The first gear is supported by bearings 44.

A total of four gears are provided within the pedal assembly 10. In addition to the push rod gear 42, a second gear 46 is mounted to the end of first threaded shaft 20, a third gear 48 is mounted to the end of a second threaded shaft 50, and a fourth gear 52 is positioned between the first and third gears. A belt 54 is positioned about the first three gears. The fourth gear 52, which is driven by an electric motor 56, is positioned outside the loop defined by the belt. Tension on the belt may also be adjusted at this point. A chain/gear assembly is preferable to the belted assembly described above since great precision is required in moving the pedal assemblies and components associated therewith.

The second threaded shaft 50 extends through an opening within the cross rod 24. A bushing 58 having a threaded bore is mounted to the shaft. The accelerator lever 18 is mounted to the cross rod 24 between the pivot bushing 58 and one of the side walls 28.

Figure 4:
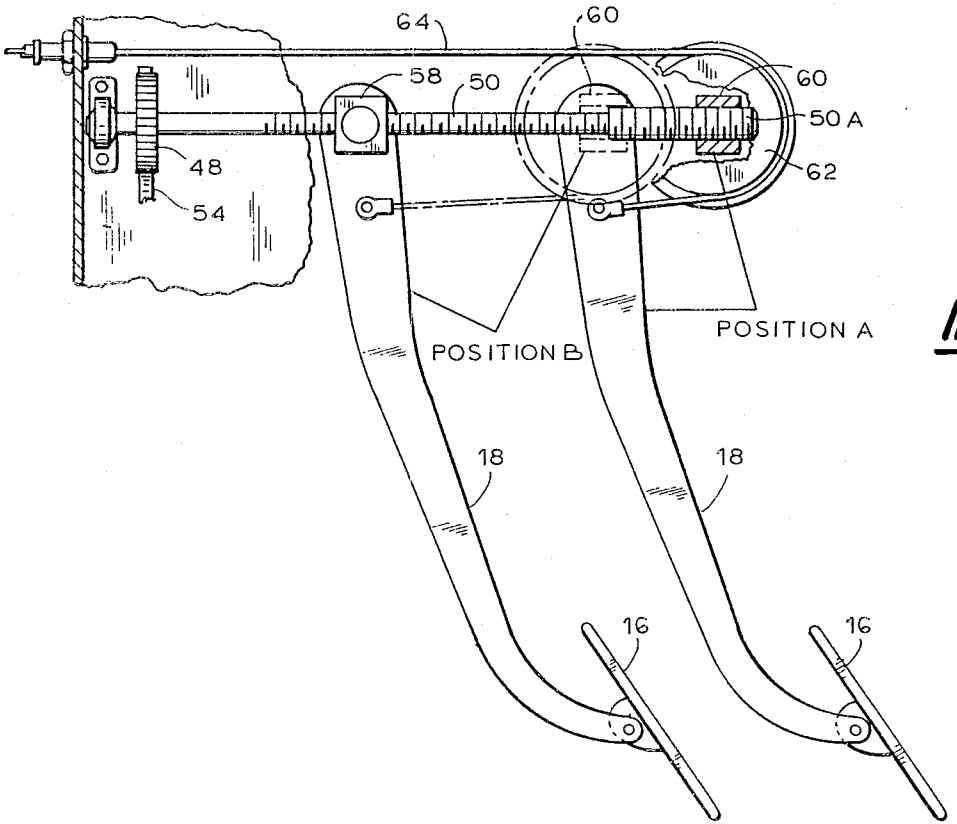
FIG. 4 is a side elevation view of an accelerator pedal assembly in accordance with the invention.

As shown in FIG. 4, one end 50A of the second threaded shaft 50 has a larger diameter than the remainder of the shaft. This end portion is also threaded. A bushing 60 having a threaded bore is mounted thereto and a pulley 62 is mounted to the bushing by a pivot pin 63. A cable 64 extends around the pulley and is secured at one end to the accelerator lever 18. The other end extends through the rear wall of the housing 30 and controls the operation of the throttle. The bushing 60 bears against the side wall 28 of the housing 30 to prevent rotation of the pulley when the threaded shaft 50 is rotated about its longitudinal axis. The side wall may include a track (not shown) upon which the bushing would slide.

The thread pitch provided within the pedal bushing 58 is about twice that provided within the pulley bushing 60. The length of the cable 64 between the accelerator lever 18 and the rear wall of the housing accordingly remains constant as the accelerator pedal assembly and the pulley travel along the threaded shaft 50 between positions A and B as shown in FIG. 4. The threaded pitch within the bushing 22 mounted to the opposite shaft 20 is substantially the same as that within the bushing 58.

In operation, the motor 56 is actuated to rotate the drive gear 52 in either direction. The drive belt 54 allows the three gears 42,46,48 within the belt to be rotated with precision. The gears cause the rotation of the push rod housing 36, first threaded shaft 20, and second threaded shaft 50, respectively.

Rotation of housing 36 causes the threaded rod 38 therein to move between the positions shown in FIGS. 2 and 3. Bushing 22 simultaneously moves between the positions shown in these figures as threaded shaft 20 rotates. The brake lever assembly accordingly moves fore and aft without changing its angular position or affecting the output thereof with respect to the booster input.

Rotation of shaft 50 causes the bushings 58,60 mounted thereto to travel between positions A and B shown in FIG. 4. The accelerator pedal assembly and the pulley 62 associated therewith accordingly move along the shaft 50. All threaded members and gears are arranged such that both pedals assemblies maintain the same angular orientations, relative positions with respect to each other and function identically in any position along the threaded shafts 20,50. Both assemblies are operatively connected to the respective bushings 22,58 by the cross rod 24 which extends through both levers 14, 18. The total distance travelled by the assemblies may be about four inches, the cross rod 24 and slots 32 providing physical limits to travel in either direction. Limit switches may also be employed to stop or reverse the motor 56 before one of the physical limits is reached. The cross rod 24 also prevents the pedal assemblies from rotating about the axes of the threaded shafts, thereby assuring linear movement thereof when the shafts are rotated.

What is claimed is:

1. A pedal assembly for a motor vehicle comprising a support, a threaded shaft, pedal lever mounting means threadably mounted to the threaded shaft, a pedal lever pivotably mounted on the pedal lever mounting means, and an actuator, characterized by the actuator having an elongate threaded bore, a threaded rod connected to the pedal lever and engaged within the bore, and power means operatively connected to the threaded shaft and the actuator for rotating the shaft and the actuator to move the pedal lever mounting means and the threaded rod relative to the support while maintaining the angular orientation of the pedal lever relative to the support.

2. The pedal assembly of claim 1, further characterized by a second threaded shaft operatively connected to the power means, second pedal lever mounting means threadably mounted to the second shaft, a second pedal lever pivotably mounted to the second mounting means, a pulley, pulley mounting means threadably mounted on the second shaft, an actuator cable extending about the pulley and having one end secured to the second pedal lever such that rotation of the second shaft by the power means moves the second pedal lever mounting means and the pulley mounting means relative to the support while maintaining the angular orientation of the second pedal lever relative thereto.

3. The pedal assembly of claim 2, further characterized by a cross rod interconnecting the first and second pedal lever mounting means to ensure translation of these mounting means along the axes of the threaded shafts during rotation of the shafts by the power means.

4. The pedal assembly of claim 3, further characterized by a gear mounted on each of the threaded shafts and on the actuator, a drive motor, and drive belt means interconnecting the gears and the motor to enable synchronized concurrent rotation of both threaded shafts and the actuator to ensure that both pedal levers maintain their angular orientation during movement thereof relative to the support upon actuation of the drive motor.

* * * * *